US007705816B2

(12) United States Patent
Chen et al.

(10) Patent No.: US 7,705,816 B2
(45) Date of Patent: Apr. 27, 2010

(54) GENERATING CORRECTED GRAY-SCALE DATA TO IMPROVE DISPLAY QUALITY

(75) Inventors: Yu-Yeh Chen, Tainan (TW); Hung-Yu Lin, Tainan (TW); Chia-Hang Lee, Tainan (TW)

(73) Assignee: Chi Mei Optoelectronics Corp. (TW)

( * ) Notice: Subject to any disclaimer, the term of this patent is extended or adjusted under 35 U.S.C. 154(b) by 582 days.

(21) Appl. No.: 11/784,943

(22) Filed: Apr. 10,2007

(65) Prior Publication Data

US 2007/0236439 A1 Oct. 11, 2007

(30) Foreign Application Priority Data

Apr. 10, 2006 (TW) ..... 95112668 A

(51) Int. Cl.
*G09G 3/36* (2006.01)

(52) U.S. Cl. ..... 345/89; 345/690; 345/691; 345/692; 345/693

(58) Field of Classification Search ..... 345/89, 345/690–693
See application file for complete search history.

(56) References Cited

U.S. PATENT DOCUMENTS 6,924,824 B2 * 8/2005 Adachi et al. ..... 345/690
7,298,347 B2 * 11/2007 Yamazaki et al. ..... 345/46
7,460,101 B2 * 12/2008 Lee et al. ..... 345/98

OTHER PUBLICATIONS

Y. Igarashi et al., "31.2: Proposal of the Perceptive Parameter Motion Picture Response Time (MPRT)," SID 03 Digest, pp. 1039-1041 (2003).

* cited by examiner

*Primary Examiner*—Richard Hjerpe
*Assistant Examiner*—Jeffrey Steinberg
(74) *Attorney, Agent, or Firm*—Trop Pruner & Hu, P.C.

(57) ABSTRACT

A method of displaying image data, which can mitigate a double-boundary problem and improve MPRT, includes the steps of: receiving a plurality of frame data of a pixel; correcting subframe data of two of the plurality frame data; and sequentially displaying each of the subframe data of the plurality frame data.

22 Claims, 14 Drawing Sheets

40

| original gray-scale value | first subframe | second subframe |
|---|---|---|
| 0 | 0 | 0 |
| 1 | 2 | 0 |
| ⋮ | ⋮ | ⋮ |
| 149 | 245 | 0 |
| 150 | 250 | 0 |
| 151 | 255 | 0 |
| 152 | 255 | 5 |
| ⋮ | ⋮ | ⋮ |
| 252 | 255 | 220 |
| 253 | 255 | 230 |
| 254 | 255 | 240 |
| 255 | 255 | 250 |

FIG. 4(PRIOR ART)

GENERATING CORRECTED GRAY-SCALE DATA TO IMPROVE DISPLAY QUALITY

CROSS-REFERENCE TO RELATED APPLICATION

This claims priority under 35 U.S.C. §119 of Taiwan Application No. 095112668, filed Apr. 10, 2006, which is hereby incorporated by reference.

TECHNICAL FIELD

The invention relates generally to generating corrected gray-scale data to improve display quality.

BACKGROUND

With improvements in liquid crystal display (LCD) technology, LCD televisions including LCD panels are becoming increasingly popular. An LCD panel includes a matrix of pixels that are driven with pixel data values to display a desired image.

In attempts to improve display quality of such LCD panels, subframes are often inserted to form pulse-like image data according to the pulse-like LCD technology. An issue with using LCD panels in televisions is that the perceived image quality can suffer as a result of edge blurring. To address this, subframes are inserted to provide luminance similar to that of a CRT (cathode ray tube) television. With one conventional technique, a normally black subframe is often inserted in each frame, as shown in FIG. 1. FIG. 1 shows two adjacent pixels 101 and 102 for respectively receiving gray-scale data A and B and displaying the gray-scale data A and B in a frame time $T_f$.

FIG. 2 shows a first pulse-like liquid crystal display technology, in which a normally black subframe (a subframe having a gray-scale value of 0) is inserted into the pixels 101 and 102 along with the gray-scale data A and B, if an image doubled frame rate technology is used. The image doubled frame rate technology refers to using a doubled frame rate so that two subframes of data can be provided in each frame. Thus, the pixels 101 and 102 of FIG. 2 respectively display the subframe with the gray-scale data A and B in the front half frame time (½ $T_f$), and display a black frame in the rear half frame time (½ $T_f$). According to the eye-tracking model, the conventional black frame inserting method can effectively halve the blurred width (or brightness edge width). However, the conventional black frame inserting method enables the pixel to display the gray-scale data correctly only during one half of the frame time, and to display the normally black frame of gray-scale data of 0 during the other half of the frame time. Thus, the frame luminance is reduced in half, thereby negatively influencing the image displaying effect.

To improve the problem of the halved pixel luminance caused by the black frame insertion technique, a second conventional subframe insertion technique does not influence the equivalent luminance of the frame. As shown in FIG. 3, when the pixels 101 and 102 receive the gray-scale data A and B, the second subframe insertion technique enables the pixel 101 to sequentially display subframes A' and C and the pixel 102 to sequentially display subframes B' and D. The average luminance of the pixel 101 for displaying the subframes A' and C in the frame time $T_f$ is the same as the luminance effect of directly displaying the gray-scale data A throughout the frame time $T_f$ in FIG. 1. The average luminance of the pixel 102 for displaying the subframes B' and D in the frame time $T_f$ is the same as the luminance effect of directly displaying the gray-scale data B throughout the frame time $T_f$ in FIG. 1.

FIG. 4 shows an example look-up table 40 used in the second subframe insertion technique of FIG. 3 for generating the subframes. As shown in FIGS. 3 and 4, the second subframe insertion technique sequentially displays two subframes having the gray-scale values of 250 and 0 when the pixel receives an original gray-scale value of 150, and two subframes having the gray-scale values of 255 and 0 when the pixel receives an original gray-scale value of 151. In the look-up table 40 of FIG. 4, the original gray-scale value not greater than 151 is mapped to various gray-scale values for the first subframe and mapped to a black value for the second subframe. The gray-scale values of the first and second subframes together provide a synthesized luminance effect that is equal to the luminance corresponding to the original gray-scale value. In addition, the original gray-scale value greater than 152, is mapped to a gray-scale value of 255 for the first subframe, and mapped to various gray-scale values for the second subframe. The gray-scale values for the second subframe are adjusted to provide a synthesized luminance effect that is equal to the luminance of the original gray-scale value.

In typical image data, the gray-scale values of the adjacent pixels are very close to each other. Thus, if the original gray-scale values of the pixels 101 and 102 of FIG. 3 are both smaller than 151, the gray-scale values C and D of the subframe are equal to 0. If the original gray-scale values of the pixels 101 and 102 are both greater than 152, the gray-scale values A' and B' of the subframe are equal to 255. The two conditions can effectively halve the blurred width of the motion picture image without influencing the image displaying luminance.

FIG. 5 is a graph for mapping first and second subframe gray-scale values to original gray-scale values, according to the look-up table 40 of FIG. 4. According to FIG. 5, the gray-scale value of the first subframe is 255 when the original gray-scale value is greater than g51, and the gray-scale value of the second subframe is 0 when the original gray-scale value is smaller than g51. The value of g51 of FIG. 5 may be any reasonable design value. For example, the value of g51 may be 151 for an 8-bit gray-scale display system.

An LCD panel is limited by the response speed of liquid crystal cells. When the gray-scale value displayed by a pixel is changed, the corresponding liquid crystal cell requires a certain response time to reach the target gray-scale value. In some cases, an over-drive technique is used to enable the pixel to switch between low and high gray-scale levels.

FIG. 6 shows a graph illustrating application of the second subframe insertion technique in conjunction with an over-drive technique. The example of FIG. 6 is for an 8-bit gray-scale display system, which has a gray-scale display range from 0 to 255. The pixel sequentially receives the pixel data of four frames f61, f62, f63 and f64 in time periods from t61 to t63, from t63 to t65, from t65 to t67 and from t67 to t69, respectively. The original gray-scale values of the four frames are successively 32, 32, 64 and 64. Thus, the liquid crystal cell sequentially receives the control voltages of V(L2), V(L0), V(L2), V(L0), V(L4), V(L0), V(L3) and V(L0) provided to the pixel according to the second subframe insertion technique. The corresponding luminances of the pixel are represented as L2, L0, L2, L0, L3, L1, L3 and L1, respectively. Note that the luminances are represented as triangular waves where increases and decreases in luminance slope upwardly or downwardly according to response times of the corresponding liquid crystal cell. However, if the response speed of the liquid crystal cell is not high enough, the liquid crystal cell cannot be charged to the voltage value for correctly displaying the gray-scale luminance L3 (for frame f63) if the liquid crystal cell is directly driven by the pixel control voltage V(L3) corresponding to the gray-scale luminance L3 after the gray-scale luminance L0 (in the previous frame f62). Thus, as shown in FIG. 6, an over-drive voltage is applied to drive the liquid crystal cell in frame f63. That is, a new pixel data voltage higher than the original pixel control voltage is applied to the liquid crystal cell from the time instant t65 to the time instant t66. For example, the control voltage V(L4) corresponding to the gray-scale luminance L4 (L4>L3) of FIG. 6 is applied so that the pixel can display the gray-scale luminance L3 immediately and correctly. Similarly, if the response speed of the liquid crystal cell is not high enough, the pixel still can only display the gray-scale luminance L1 rather than the full black at the time instant t67 although the control voltage is dropped to 0 from the time instant t66 to the time instant t67. Because the pixel is not fully black at the time instant t67, no over-drive voltage has to be applied from the time instant t67 to the time instant t68, and only the control voltage V(L3) correctly corresponding to the gray-scale luminance L3 needs to be applied for the pixel to correctly display the gray-scale luminance L3.

However, the conventional pulse-like liquid crystal display adopting the driving technique of FIG. 6 usually has the problems of double-boundary (or double image) and poor MPRT (Motion Picture Response Time), which degrades motion picture quality. For example, the double-boundary problem results from the integration areas of the frame times between t63 and t65 and between t65 and t67 being significantly different from each other.

FIG. 7 shows an eye stimuli integration curve corresponding to the technique of FIG. 6, wherein the horizontal axis represents the time, the vertical axis represents the normalized intensity, and the turning portion of A is where the double-boundary occurs. Thus, although the driving technique of FIG. 6 can be used for the purpose of correcting the image by re-adjusting the single subframe data of a single frame, the technique cannot improve the double-boundary problem completely, and even induces the condition of boundary overshooting or boundary undershooting.

In addition, an NBET parameter is widely used to represent the motion picture quality. The NBET parameter is defined as follows:

$$NBEW=BEW/\text{velocity}, \quad \text{(Eq. 1)}$$

$$NBET=NBEW/\text{frame rate}, \quad \text{(Eq. 2)}$$

where BEW is the blurred boundary width of the motion picture image. A smaller NBET value represents less blurred boundary of the motion picture image and thus better motion picture quality. A greater NBET value is obtained when the phenomenon illustrated by the turning portion of A in FIG. 7 occurs, increasing the blurred boundary and decreasing the motion picture quality.

BRIEF DESCRIPTION OF THE DRAWINGS

FIG. 4 shows a look-up table used by the second conventional technique;

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

Figure 1:
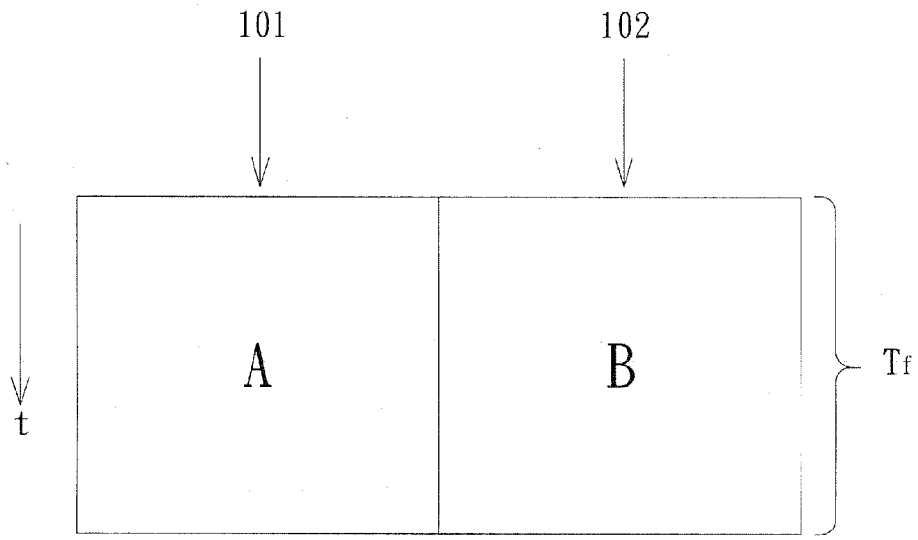
FIG. 1(PRIOR ART)
FIG. 1 is a schematic illustration showing two pixels for respectively receiving gray-scale data, according to a conventional technique.
Figure 2:
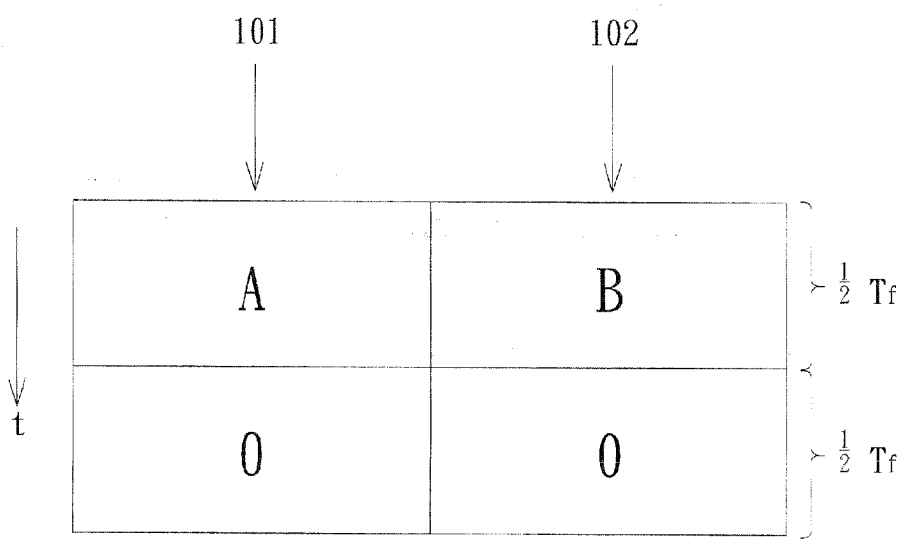
FIG. 2(PRIOR ART)
FIG. 2 is a schematic illustration showing two pixels, which receive the gray-scale data at doubled frame rates according to a first conventional technique.
Figure 3:
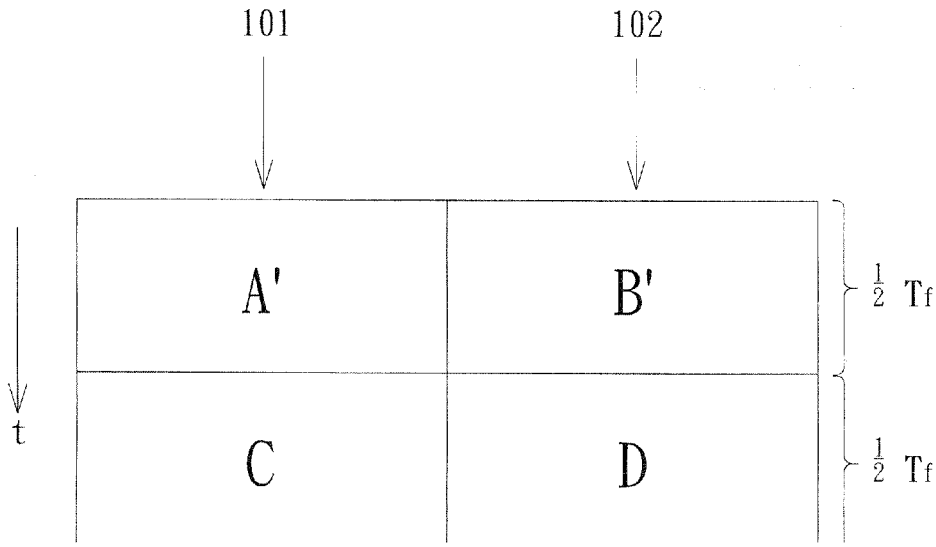
FIG. 3(PRIOR ART)
FIG. 3 is a schematic illustration showing two pixels, which receive the gray-scale data at doubled frame rates according to a second conventional technique.
Figure 5:
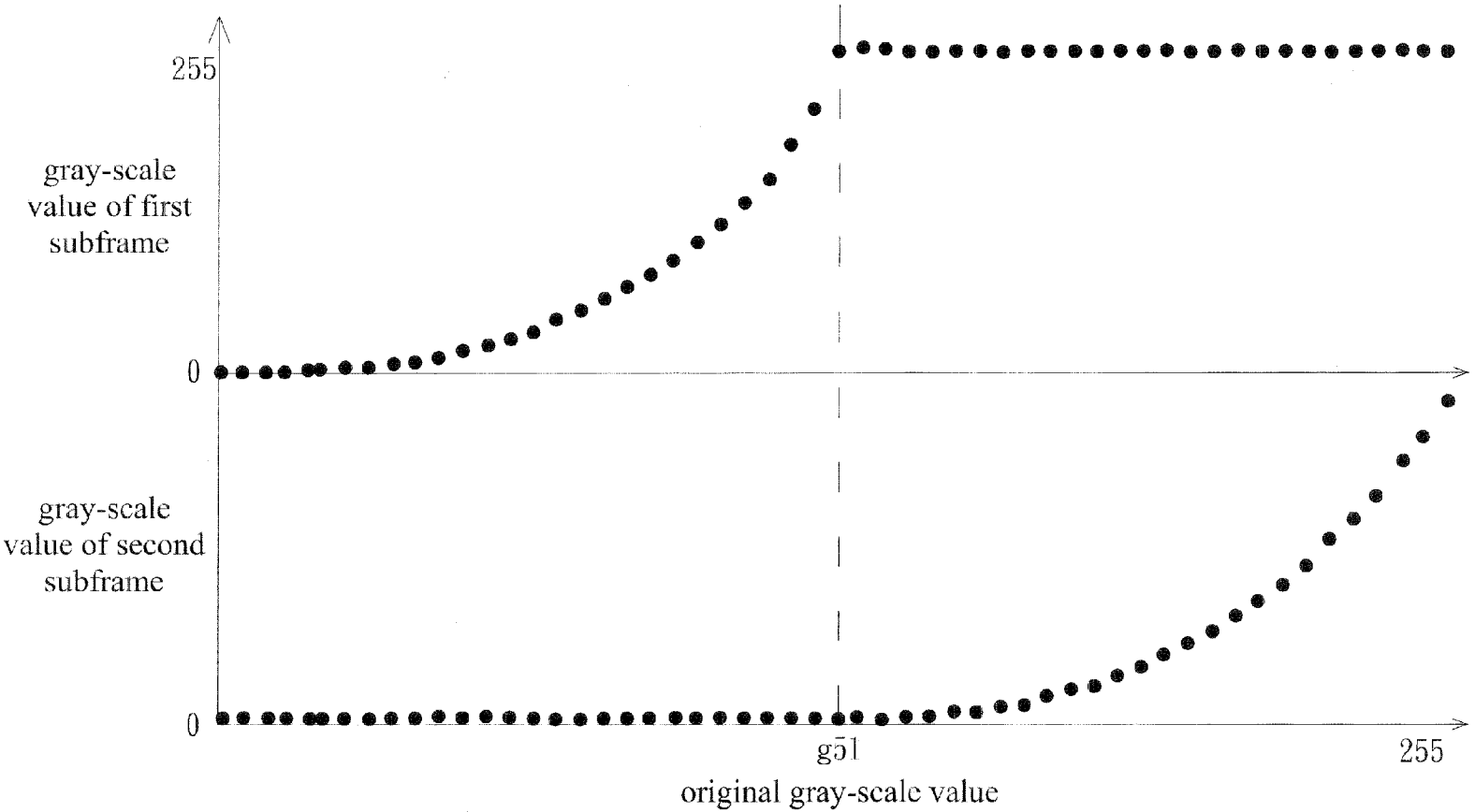
FIG. 5(PRIOR ART)
FIG. 5 is a graph mapping subframe gray-scale values to original gray-scale values according to the lookup table of FIG. 4.
Figure 6:
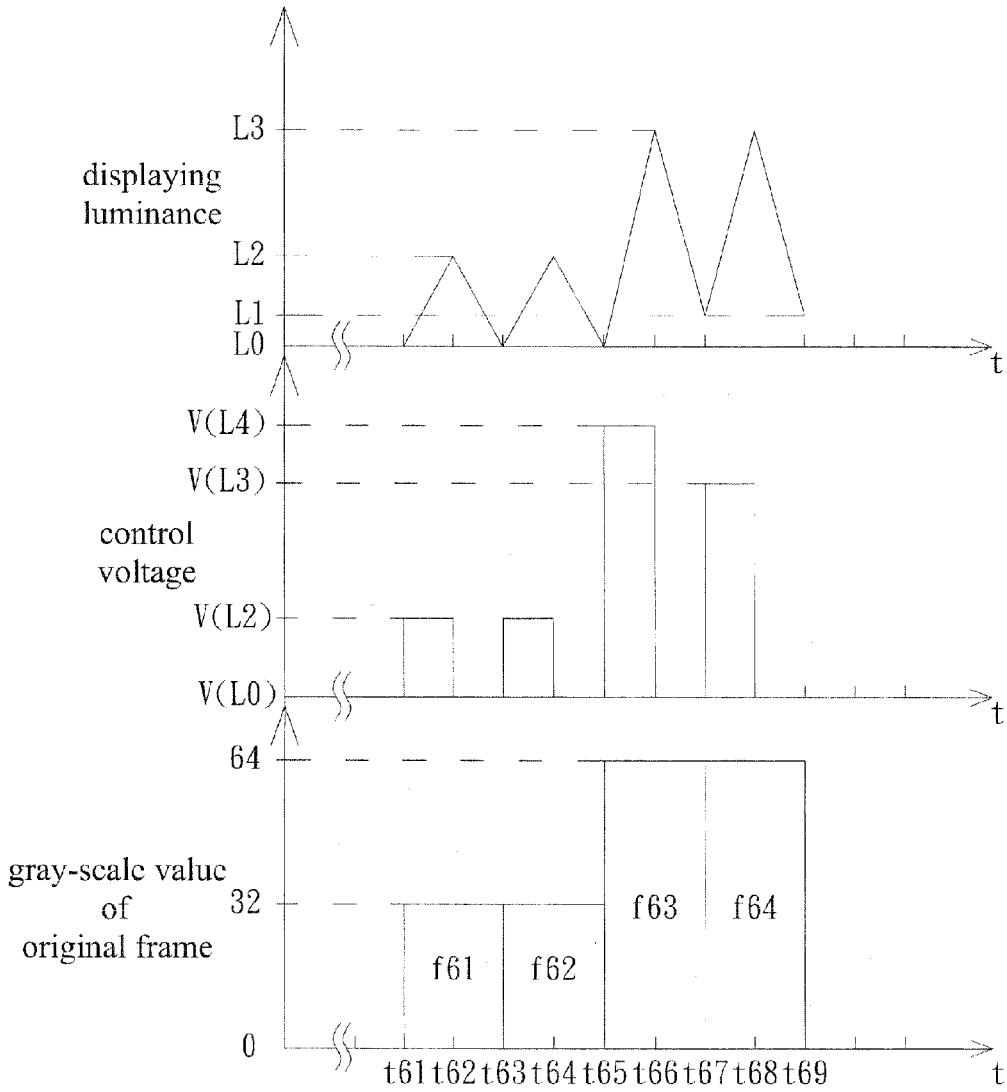
FIG. 6(PRIOR ART)
FIG. 6 illustrates timing charts corresponding to a technique of using the second conventional technique in conjunction with an over-drive technique.

To reduce or eliminate excessively long boundary blur of a motion picture image caused by the inadequate response speed of liquid crystal cells in a liquid crystal display (LCD) panel, a conventional driving technique simply adjusts the control voltage of a particular frame at the portion where the input gray-scale signal changes (i.e., the portion where the luminance changes) so as to change (lift or lower) the triangular wave of the luminance with respect to the time axis (see, e.g., FIG. 6). However, the conventional driving technique is unable to adequately solve the double-boundary problem or may even cause boundary overshooting or boundary undershooting.

In contrast, a driving technique according to some embodiments adjusts the control voltage of a particular frame where the luminance changes (i.e., when the input gray-scale data changes), based on frame data of the particular frame as well as frame data of the next frame, to address the double-boundary problem and to effectively reduce the blurred boundary problem.

Figure 8:
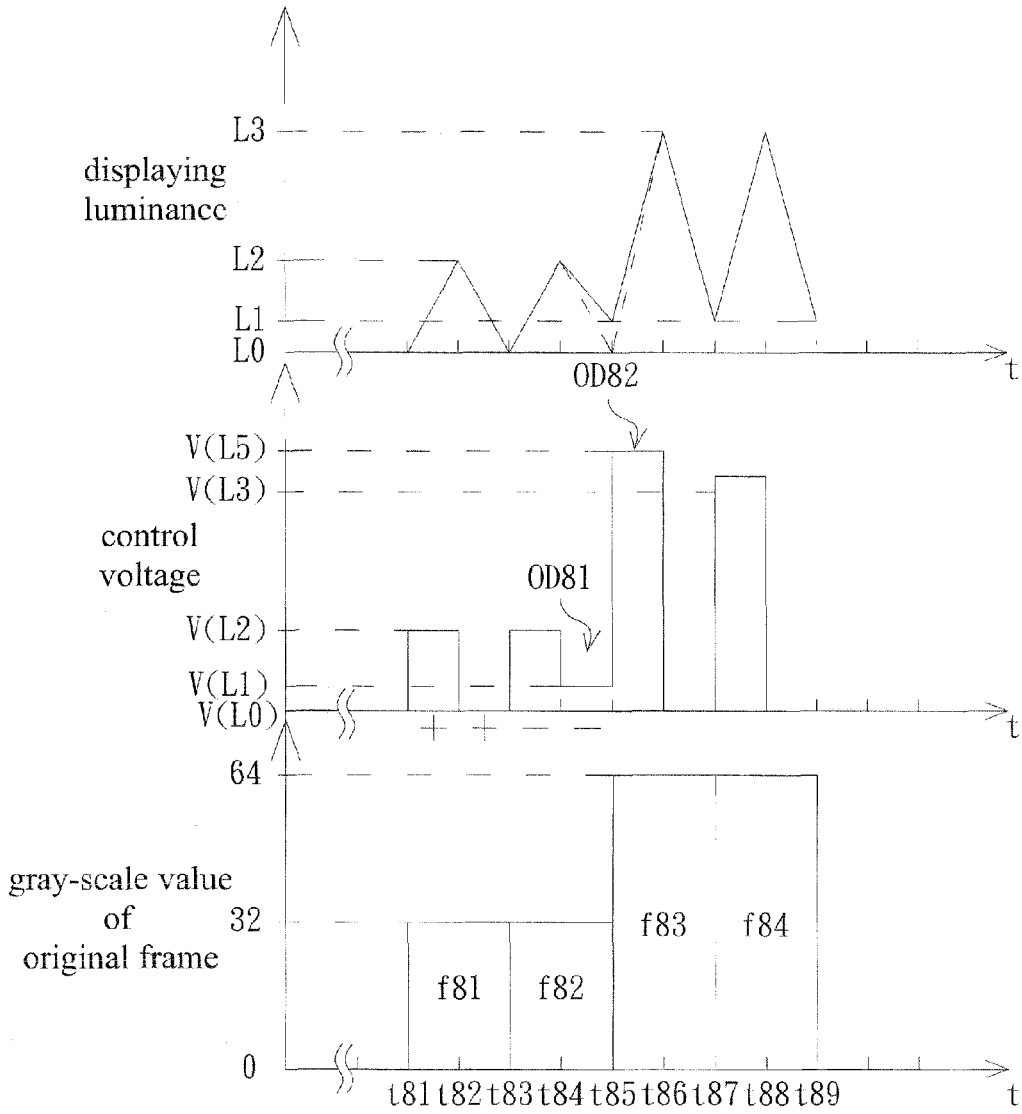
FIG. 8 illustrates timing charts corresponding to a driving technique according to a first embodiment of the invention.

FIG. 8 shows timing diagrams of frames as a function of time, corresponding control voltages as a function of time, and corresponding luminances as a function of time. In one example, the display system is assumed to be an 8-bit gray-scale display system, which has a gray-scale display range from 0 to 255. Control voltages represent pixel voltages applied to a pixel in a matrix of pixels of an LCD panel. As shown in FIG. 8, the pixel successively receives the pixel data of four frames f81, f82, f83 and f84 in the time periods from t81 to t83, from t83 to t85, from t85 to t87 and from t87 to t89, respectively. The gray-scale values of the four frames are successively 32, 32, 64 and 64. In accordance with an embodiment, the control voltages of the pixel of the second subframe of the frame f82 and the first subframe of the next frame f83 (control voltages OD81 and OD82, respectively, in FIG. 8) are adjusted. The adjusted control voltages OD81 and OD82 correspond to time periods (t84, t85) and (t85, t86), respectively, during which the luminance changes (i.e., the time where the input gray scale signal changes) by a relatively large amount (greater than some threshold). The driving technique according to an embodiment increases the control voltage of the second subframe of the frame f82 from the original control voltage V(L0) corresponding to the gray-scale luminance L0, to a higher control voltage V(L1), which is OD81, corresponding to the gray-scale luminance L1. Moreover, the driving technique decreases the control voltage of the first subframe of the frame f83 from the over-drive control voltage V(L4) of the original gray-scale luminance L4 to the over-drive control voltage V(L5), which is OD82, corresponding to the gray-scale luminance L5 (where L3<L5<L4).

Note that in time period (t85, t86), the control voltage is over-driven to V(L5), which is above V(L3) corresponding to the original luminance L3. However, V(L5) is less than V(L4), which is the over-drive voltage used in the conventional driving technique of FIG. 6 (in time period t65). Consequently, the displayed luminance at the time instant t85 (the initial time point of the first subframe of the frame f83) is not the original gray-scale luminance L0 but is the gray-scale luminance L1 of the second subframe of the frame f82. In this manner, the double-boundary problem can be addressed, and the blurring of the boundary can be reduced, such that the display quality of the motion picture can be effectively enhanced.

The adjusted control voltages OD81 and OD82 are determined according to the stable frame data after the frame f84 (as well as frame data in frames f82 and f83). The corrected subframe data of the first frame (e.g., f82) and the second frame (e.g., f83) are determined according to the data of the third frame (e.g., f84). In order to achieve a superior display quality, the adjustment of the control voltage OD81 may follow the principle for adjusting the control voltage OD81 to make the displayed luminance of the first subframe (time instant t85) of the frame f83 equal to 50% to 100% of the displayed luminance of the first subframe (time instant t87) of the frame f84. The control voltage OD82 is adjusted to make the displayed luminance of the second subframe of the frame f83 (time instant t86) equal to 90% to 110% of the displayed luminance of the second subframe of the frame f84 (time instant t88).

The doubled frame rate technique may first generate and display, within each corresponding frame, a high-luminance subframe followed by a low-luminance subframe (see FIG. 8) with respect to each frame, or may alternatively first generate and display the low-luminance subframe followed by the high-luminance subframe. Driving techniques according to some embodiments may be adapted to either of the two types of frame inserting and doubled frame rate technology.

Figure 9:
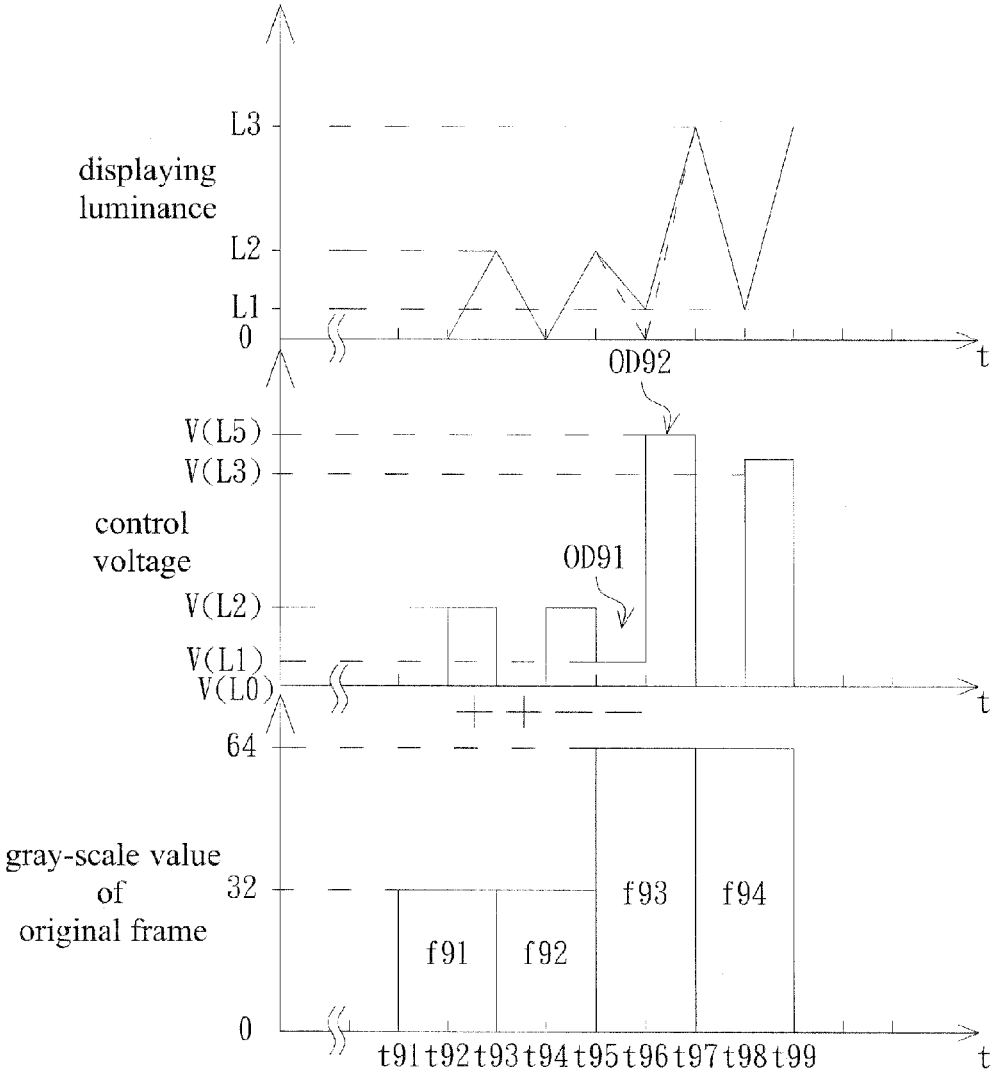
FIG. 9 illustrates timing charts corresponding to a driving technique according to a second embodiment of the invention.

FIG. 9 illustrates timing diagrams (frames, control voltages, and luminances) for the driving technique that initially generates and displays a low-luminance subframe followed by a high-luminance subframe in an example 8-bit gray-scale display system. As shown in FIG. 9, a pixel successively receives the pixel data of the four frames f91, f92, f93 and f94 in the time periods from t91 to t93, from t93 to t95, from t95 to t97 and from t97 to t99, respectively. The gray-scale values of the four frames are successively 32, 32, 64 and 64. With this driving technique, the control voltages OD91 and OD92 in the first subframe and the second subframe of the frame f93, where the luminance changes by greater than a threshold, are adjusted. The driving technique increases the control voltage (OD91) of the first subframe of the frame f93 to be V(L1) instead of the control voltage V(L0) corresponding to the original gray-scale luminance L0, and reduces the over-drive control voltage (OD92) of the second subframe of the frame f93 to V(L5), which is less than V(L4). Note that the over-drive voltage V(L5) is used in place of V(L3) that corresponds to the original gray-scale L3. With this technique, when the liquid crystal display technology is for initially displaying the low gray-scale subframe and then subsequently the corresponding high gray-scale subframe, the MPRT response curve can also be improved.

The control voltage OD91 is determined according to the stable frame data after the frame f94 (as well as frame data in frame f93). In other words, the corrected subframe data of the second frame (e.g., f93) is determined according to the data of the third frame (e.g., f94) and of the second frame (e.g., f93). To achieve a superior display quality, the control voltage OD91 can be adjusted according to the principle for adjusting the control voltage OD91 to make the displayed luminance of the second subframe (time instant t96) of the frame f93 equal to 50% to 100% of the displayed luminance of the first subframe (time instant t98) of the frame f94. Moreover, the control voltage OD92 is determined to make the displayed luminance of the first subframe of the frame f94 (time instant t97) equal to 90% to 110% of the displayed luminance of the first subframe of the frame after frame f94 (time instant t99).

In addition, to prevent the average luminance displayed by every frame (especially the frame representing a single gray-scale) from changing due to the polarity change of the subframe data, the high gray-scale subframe data and the low gray-scale subframe data of each frame data should have the same polarity and two continuous adjacent frame data should have different polarities. Alternatively, the high gray-scale subframe data and the low gray-scale subframe data of each frame data have different polarities, when the subframe data of successive two adjacent frame data have opposite polarity arrangements. The two principles mentioned above are suitable for the typical doubled frame rate technology for initially generating and displaying the high-luminance subframe and subsequently the low-luminance subframe, or alternatively, initially generating and displaying the low-luminance subframe and subsequently the high-luminance subframe.

In addition, the low-luminance subframe may be a normally black subframe or a subframe with a lower gray-scale luminance.

Figure 10:
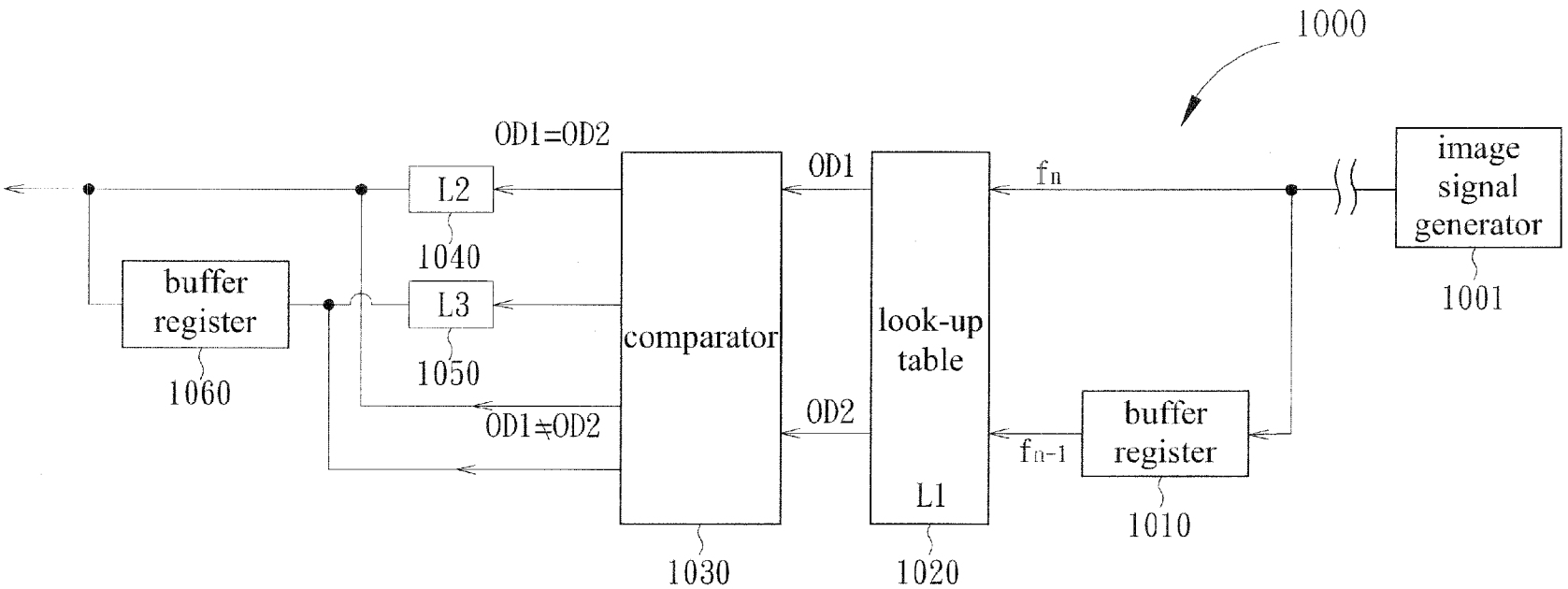
FIG. 10 is a block diagram of a circuit architecture to provide a driving technique according to some embodiments.

To implement the above-mentioned driving techniques, a circuit architecture 1000 according to FIG. 10 can be employed. As shown in FIG. 10, the circuit architecture 1000 receives a first frame signal $f_{n-1}$ and a second frame signal $f_n$, which are generated by an image signal generator according to a timing sequence. The circuit architecture 1000 includes an image signal generator 1001, a buffer register 1010, a look-up table 1020, a comparator 1030 and two look-up tables 1040 and 1050. The buffer register 1010 stores the first frame signal $f_{n-1}$. The look-up table 1020 is electrically coupled to the buffer register 1010 and generates a first over-drive voltage OD1 and a second over-drive voltage OD2 according to the first frame signal and the second frame signal, $f_{n-1}$, $f_n$, respectively (which are generated by the image signal generator 1001). The comparator 1030 is electrically connected to the first look-up table 1020 to compare the first over-drive voltage OD1 with the second over-drive voltage OD2 to determine whether the first over-drive voltage OD1 and the second over-drive voltage OD2 are substantially the same (within a predefined threshold). The two look-up tables 1040 and 1050 are electrically connected to the comparator 1030 and respectively determine a corrected first over-drive voltage and a corrected second over-drive voltage according to the comparison result of the comparator regarding whether the first over-drive voltage OD1 and the second over-drive voltage OD2 are substantially the same (e.g., OD1 and OD2 differ by less than the predefined threshold). Next, the corrected first over-drive voltage and the corrected second over-drive voltage are sequentially output through a buffer register 1060. If OD1 and OD2 are substantially the same, then the lookup tables 1040 and 1050 are used to correct OD1 and OD2. However, if OD1 and OD2 are not substantially the same, then correction using the lookup tables OD1 and OD2 is bypassed.

OD1 and OD2 correspond to OD81 and OD82, respectively, in FIG. 8, and to OD91 and OD92, respectively, in FIG. 9. Using the circuit of FIG. 10, the correction of OD1 and OD2 is performed based on the comparison of the original OD1 and OD2 values.

Figure 11:
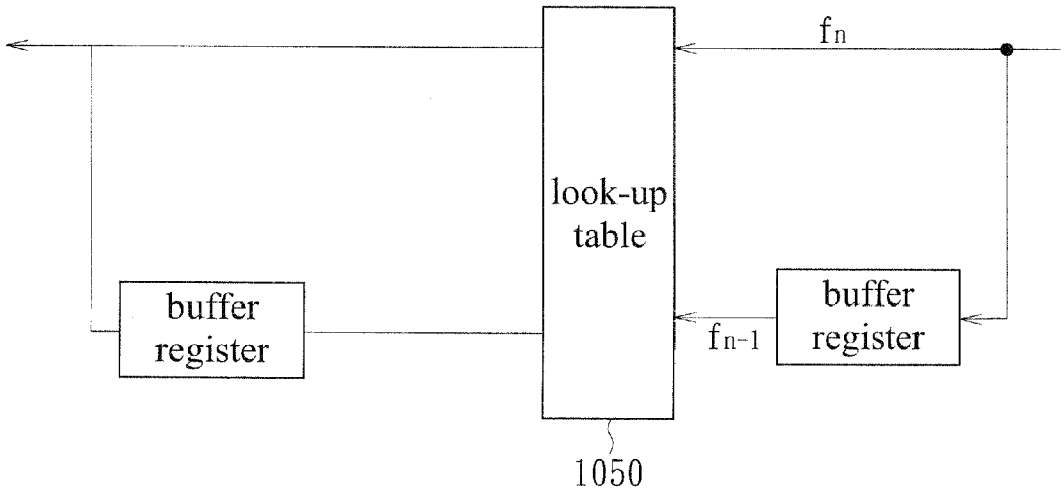
FIG. 11 is an overall functional block diagram showing the circuit architecture of FIG. 10.

FIG. 11 is an overall functional block diagram showing the circuit architecture 1000 of FIG. 10. As shown in FIG. 11, the buffer register stores the first frame signal $f_{n-1}$. The look-up table generates the corresponding output signal according to the first frame signal $f_{n-1}$ and the second frame signal $f_n$. That is, the look-up tables 1020, 1040 and 1050 of FIG. 10 are integrated to form a look-up table 1050 of FIG. 11.

Figure 14:
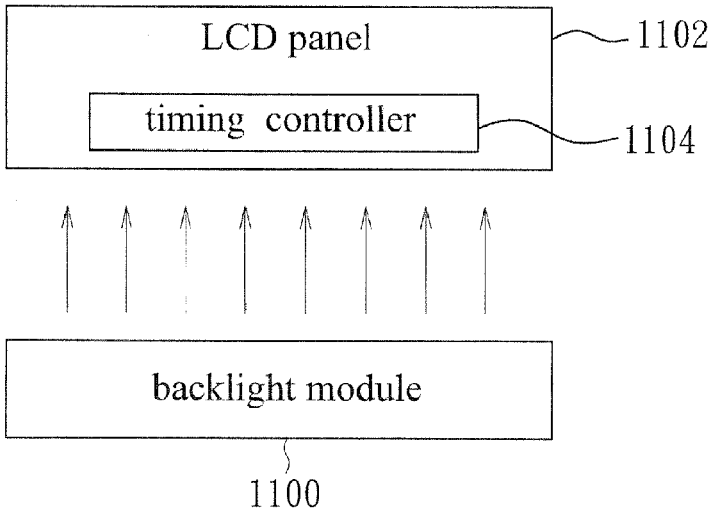
FIG. 14 is a schematic diagram of a display device incorporating an embodiment.

FIG. 14 illustrates a display device that has a backlight module 1100 to generate light directed through an LCD panel 1102. The LCD panel 1102 has a timing controller 1104 that includes the circuit of FIG. 10, as well as other circuitry to provide data signals to the matrix of pixels of the LCD panel 1102.

Figure 7:
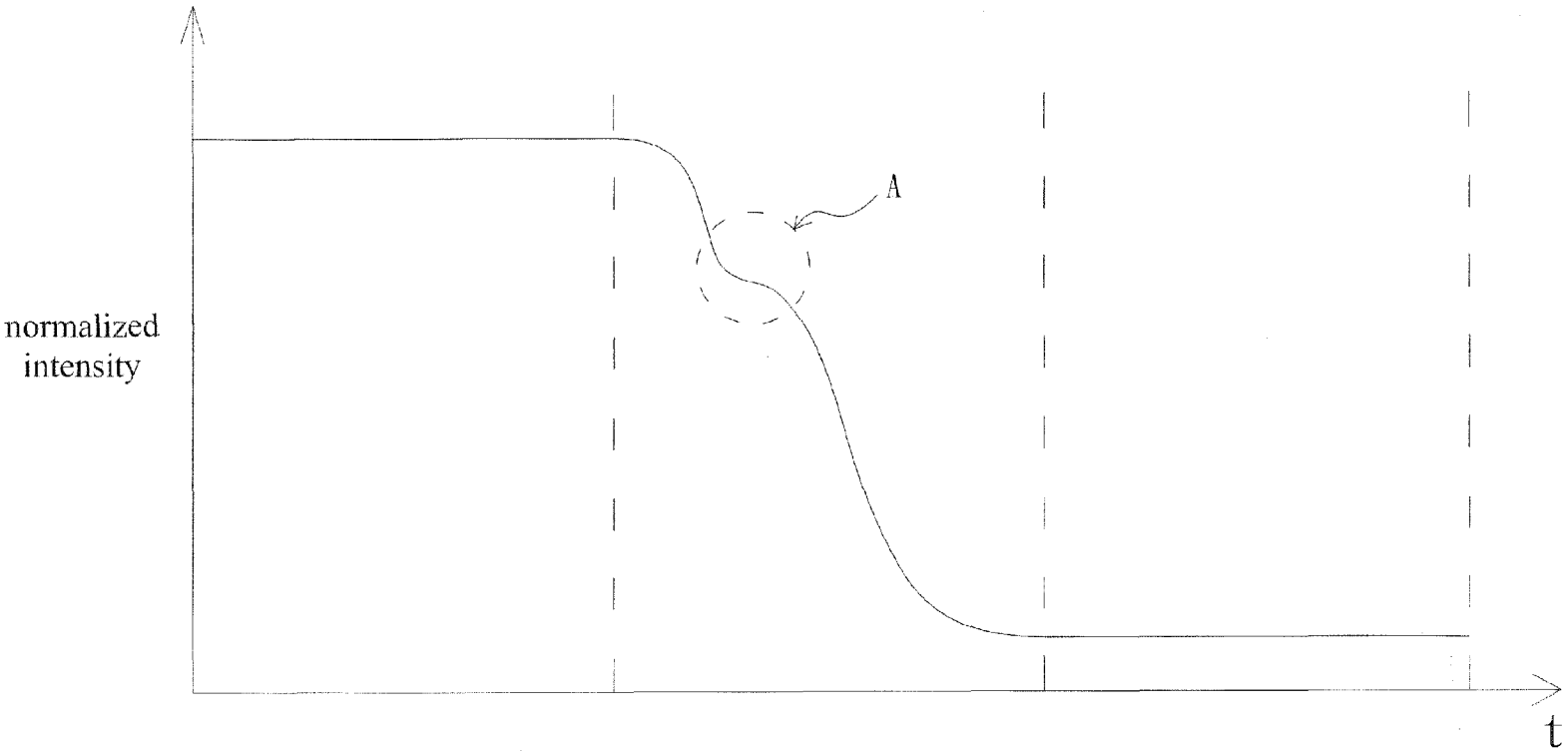
FIG. 7(PRIOR ART)
FIG. 7 shows an eye stimuli integration curve corresponding to the driving technique of FIG. 6.
Figure 12:
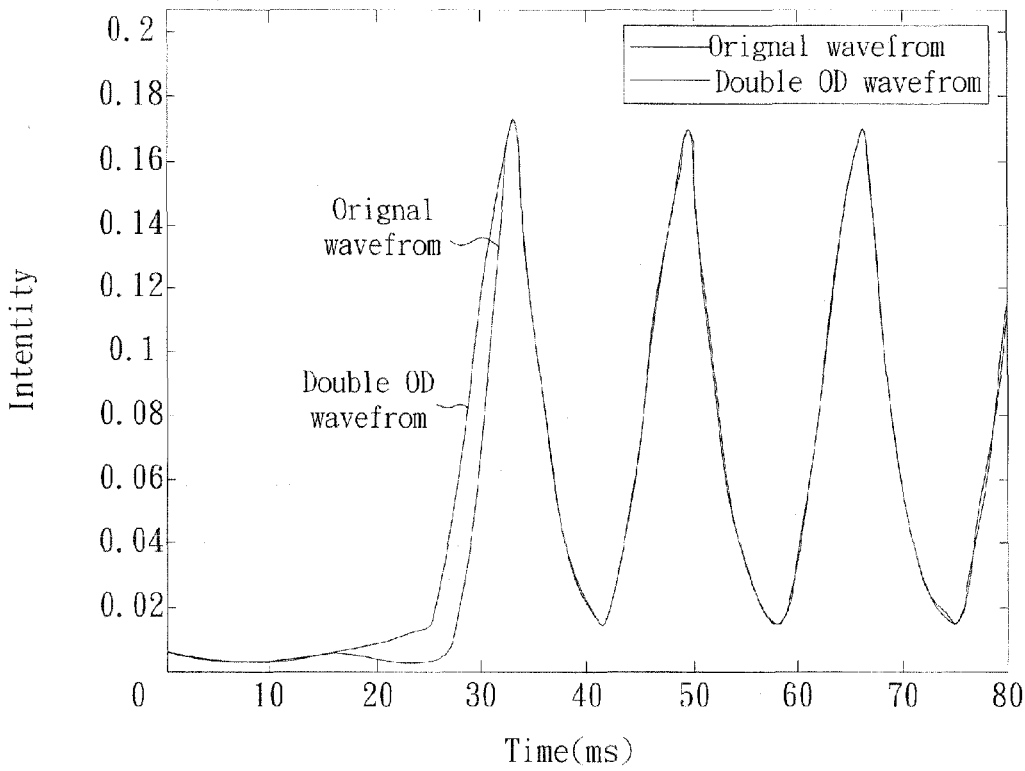
FIG. 12 is a timing chart showing a simulated result according to a driving technique according to some embodiments.
Figure 13:
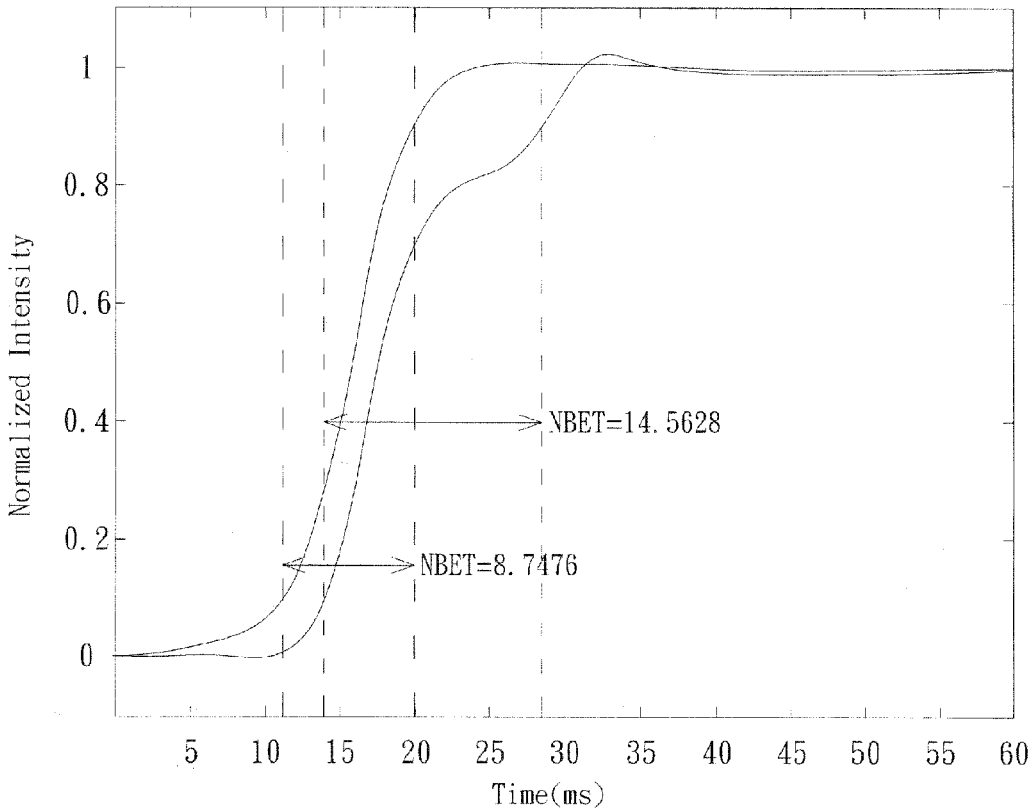
FIG. 13 is a timing chart showing another simulated result according to a driving technique according to some embodiments.

FIGS. 12 and 13 illustrate simulated results derived based on a driving technique according to an embodiment. FIG. 12 illustrates the luminance obtained using the driving technique, and FIG. 13 illustrates the MPRT according to FIG. 12. Referring to FIG. 13, the NBET value based on the driving technique according to an embodiment is greatly reduced so that the blurring of boundaries can be reduced. Compared with FIG. 7, the normalized intensity curve of FIG. 13 is smoother.

In summary, some embodiments of the invention provide an image data driving technique capable of optimizing MPRT to reduce the double-boundary problem and blurring phenomenon. The driving technique according to an embodiment may apply the doubled frame rate technology for initially displaying the high gray-scale subframe and subsequently the low gray-scale subframe, or alternatively, for initially displaying the low gray-scale subframe and subsequently the high gray-scale subframe. The improvement is most significant when the displayed frame changes from low gray-scale to high gray-scale. Thus, the efficiency of the display is simply and effectively enhanced.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. A method of improving image display quality, comprising:

receiving first frame data, second frame data and third frame data of a pixel, wherein each of the first frame data, the second frame data and the third frame data comprises high gray-scale subframe data and low gray-scale subframe data;

generating corrected low gray-scale subframe data of the first frame data and corrected high gray-scale subframe data of the second frame data according to the first frame data, the second frame data and the third frame data; and sequentially displaying the high gray-scale subframe data of the first frame data, the corrected low gray-scale subframe data of the first frame data, the corrected high gray-scale subframe data of the second frame data, the low gray-scale subframe data of the second frame data, the high gray-scale subframe data of the third frame data and the low gray-scale subframe data of the third frame data.

2. The method according to claim 1, wherein a control voltage value corresponding to the corrected low gray-scale subframe data of the first frame data is greater than a control voltage value corresponding to the low gray-scale subframe data of the first frame data.

3. The method according to claim 1, wherein a control voltage value corresponding to the corrected high gray-scale subframe data of the second frame data is less than a control voltage value corresponding to the high gray-scale subframe data of the second frame data.

4. The method according to claim 3, wherein the control voltage value corresponding to the high gray-scale subframe data of the second frame data is a first over-drive voltage value, and the control voltage corresponding to the corrected high gray-scale is a second over-drive voltage value less than the first over-drive voltage value.

5. The method according to claim 1, wherein the high gray-scale subframe data and the low gray-scale subframe data of the first frame data have the same polarity, and the high gray-scale subframe data and the low gray-scale subframe data of the second frame data have the same polarity.

6. The method according to claim 1, wherein the first frame data and the second frame data have opposite polarities.

7. The method according to claim 1, further comprising:

generating the corrected low gray-scale subframe data of the first frame data according to at least one of the low gray-scale subframe data of the second frame data and the low gray-scale subframe data of the third frame data.

8. The method according to claim 1, further comprising:

generating the corrected high gray-scale subframe data of the second frame data according to the high gray-scale subframe data of the third frame data.

9. The method according to claim 1, wherein each of the frames includes a first subframe and a second subframe, wherein generating the corrected low gray-scale subframe data comprises adjusting a control voltage to provide a displayed luminance of a first subframe of the second frame equal to 50% to 100% of a displayed luminance of the first subframe of the third frame, and wherein generating the corrected high gray-scale subframe data comprises adjusting a control voltage to provide a displayed luminance of the second subframe of the second frame equal to 90% to 110% of a displayed luminance of the second subframe of the third frame.

10. A method of improving image display quality, comprising:

receiving first frame data, second frame data and third frame data of a pixel, wherein each of the first frame data, the second frame data and the third frame data comprises low gray-scale subframe data and high gray-scale subframe data;

generating corrected low gray-scale subframe data of the second frame data and corrected high gray-scale subframe data of the second frame data according to the second frame data and the third frame data; and sequentially displaying the low gray-scale subframe data of the first frame data, the high gray-scale subframe data of the first frame data, the corrected low gray-scale subframe data of the second frame data, the corrected high gray-scale subframe data of the second frame data, the low gray-scale subframe data of the third frame data, and the high gray-scale subframe data of the third frame data.

11. The method according to claim 10, wherein a control voltage value corresponding to the corrected low gray-scale subframe data of the second frame data is greater than a control voltage value corresponding to the low gray-scale subframe data of the second frame data.

12. The method according to claim 10, wherein a control voltage value corresponding to the corrected high gray-scale subframe data of the second frame data is less than a control voltage value corresponding to the high gray-scale subframe data of the second frame data.

13. The method of claim 12, wherein the control voltage value corresponding to the high gray-scale subframe data of the second frame data is a first over-drive voltage values, and the control voltage corresponding to the corrected high gray-scale is a second over-drive voltage value less than the first over-drive voltage value.

14. The method according to claim 10, wherein the high gray-scale subframe data and the low gray-scale subframe data of the first frame data have the same polarity, and the high gray-scale subframe data and the low gray-scale subframe data of the second frame data have the same polarity.

15. The method according to claim 10, wherein the first frame data and the second frame data have opposite polarities.

16. The method according to claim 10, further comprising:

generating the corrected low gray-scale subframe data of the second frame data according to at least one of the low gray-scale subframe data of the first frame data and the low gray-scale subframe data of the third frame data.

17. The method according to claim 10, further comprising:

generating the corrected high gray-scale subframe data of the second frame data according to the high gray-scale subframe data of the third frame data.

18. The method according to claim 10, wherein each of the frames includes a first subframe and a second subframe, wherein generating the corrected low gray-scale subframe data comprises adjusting a control voltage to provide a displayed luminance of a second subframe of the second frame equal to 50% to 100% of a displayed luminance of the first subframe of the third frame, and wherein generating the corrected high gray-scale subframe data comprises adjusting a control voltage to provide a displayed luminance of the first subframe of the third frame equal to 90% to 110% of a displayed luminance of a first subframe of a frame after the third frame.

19. A display apparatus comprising:

a liquid crystal display panel;

a backlight module; and a timing controller to:

receive first frame data, second frame data, and third frame data of a pixel, wherein each of the first frame data and the second frame data comprises high gray-scale subframe data and low gray-scale subframe data;

generate corrected low gray-scale subframe data of the first frame data and corrected high gray-scale subframe data of the second frame data according to the first frame data, the second frame data, and the third frame data; and sequentially output the high gray-scale subframe data of the first frame data, the corrected low gray-scale subframe data of the first frame data, the corrected high gray-scale subframe data of the second frame data, and the low gray-scale subframe data of the second frame data.

20. The apparatus according to claim 19, wherein the first frame data and the second frame data are for determining whether the low gray-scale subframe data of the first frame data and the high gray-scale subframe data of the second frame data have to be corrected; and the third frame data is for determining the corrected low gray-scale subframe data of the first frame data and the corrected high gray-scale subframe data of the second frame data.

21. A display apparatus comprising:

a liquid crystal display panel;

a backlight module; and a timing controller to:

receive first frame data, second frame data and third frame data of a pixel, wherein each of the first frame data, the second frame data and the third frame data comprises high gray-scale subframe data and low gray-scale subframe data;

generate corrected low gray-scale subframe data of the second frame data and corrected high gray-scale subframe data of the second frame data according to the first frame data, the second frame data, and the third frame data; and sequentially output the low gray-scale subframe data of the first frame data, the high gray-scale subframe data of the first frame data, the corrected low gray-scale subframe data of the second frame data, the corrected high gray-scale subframe data of the second frame data, the low gray-scale subframe data of the third frame data, and the high gray-scale subframe data of the third frame data.

22. The apparatus according to claim 21, wherein the first frame data and the second frame data are for determining whether the low gray-scale subframe data of the second frame data and the high gray-scale subframe data of the second frame data have to be corrected; and the third frame data is for determining the corrected low gray-scale subframe data of the second frame data and the corrected high gray-scale subframe data of the second frame data.

* * * * *